US005318127A

United States Patent [19]

Hines et al.

[11] Patent Number: 5,318,127

[45] Date of Patent: Jun. 7, 1994

[54] SURFACE CONTROLLED ANNULUS SAFETY SYSTEM FOR WELL BORES

[75] Inventors: Craig D. Hines; Rennie L. Dickson, both of Carrollton, Tex.

[73] Assignee: Halliburton Company, Houston, Tex.

[21] Appl. No.: 923,549

[22] Filed: Aug. 3, 1992

[51] Int. Cl.[5] ..... E21B 34/10

[52] U.S. Cl. ..... 166/321; 166/322

[58] Field of Search ..... 166/320, 321, 322, 332

[56] References Cited

U.S. PATENT DOCUMENTS

| | | | |
|---|---|---|---|
| 2,780,290 | 2/1957 | Natho | 166/72 |
| 2,798,561 | 7/1975 | True | 166/224 |
| 4,049,052 | 9/1977 | Arendt | 166/183 |
| 4,161,219 | 7/1979 | Pringle | 166/324 |
| 4,444,266 | 4/1984 | Pringle | 166/324 |
| 4,452,310 | 6/1984 | Pringle et al. | 166/319 |
| 4,467,870 | 8/1984 | Langham | 166/321 |
| 4,475,598 | 10/1984 | Brakhage, Jr. et al. | 166/321 |
| 4,527,630 | 7/1985 | Pringle | 166/321 |
| 4,583,596 | 4/1986 | Davis | 166/332 |
| 4,682,656 | 7/1987 | Waters | 166/372 |
| 4,842,074 | 6/1989 | Hines et al. | 166/305.1 |
| 4,945,993 | 8/1990 | Dickson et al. | 166/321 |
| 5,022,427 | 6/1991 | Churchman et al. | 137/155 |
| 5,048,610 | 9/1991 | Ross et al. | 166/372 |
| 5,199,494 | 4/1993 | Williamson, Jr. | 166/332 X |

FOREIGN PATENT DOCUMENTS

| | | | |
|---|---|---|---|
| 1170982 | 7/1984 | Canada | 166/44 |
| 3541826 | 7/1989 | Fed. Rep. of Germany | E21B 34/10 |
| 1539153 | 3/1977 | United Kingdom . | |
| 2093499 | 1/1982 | United Kingdom . | |

*Primary Examiner*—William P. Neuder

*Attorney, Agent, or Firm*—Tracy W. Druce; Thomas V. Malorzo; Mason M. Campbell

[57] ABSTRACT

A safety system including a surface controlled subsurface safety valves for use in a well having annulus fluid flow. One of the safety valves has a valve closure member, and a small diameter offset piston actuator to move the valve closure member in response to control fluid pressure conducted from the well surface to its open position which allows annulus fluid flow. A spring biases the valve closure member to block annulus fluid flow. The annulus safety valve has an enlarged flow area for use in high volume gas injection wells. The annulus safety valve has metal-to-metal sealing systems to improve valve life under harsh downhole well environments.

20 Claims, 4 Drawing Sheets

SURFACE CONTROLLED ANNULUS SAFETY SYSTEM FOR WELL BORES

FIELD OF THE INVENTION

This invention relates to surface controlled subsurface safety valves used in the oil and gas industry and particularly to hydraulically operated valves with small piston areas and metal-to-metal seal systems.

DESCRIPTION OF RELATED ART

It is common practice to complete oil and gas wells with a casing string partially defining the wellbore and a production tubing string installed within the casing string to conduct fluid flow between the well surface and selected downhole locations. Some well completions are designed to allow fluid flow in the annulus region between the exterior of the production tubing string and the interior of the casing string. Safety valves are frequently installed at selected downhole locations in the wellbore to block fluid flow through the production tubing string and/or the well annulus in the event of an emergency or dangerous conditions at the well surface. Various well completions with alternative casing and production tubing configurations will be discussed later in this written description. The present invention is not limited to use in only oil and gas producing wells and can be used in geothermal wells, injections wells, and any other well with annulus fluid flow requiring a safety system to control such fluid flow.

The present invention is applicable to downhole safety systems having a subsurface safety valve controlled from the well surface to block fluid flow in the well's production tubing string and another subsurface safety valve controlled from the well surface to block fluid flow in the annulus between the casing and tubing string. Generally, such valves are controlled in response to hydraulic fluid pressure conducted to the respective valve from a remote location at the well surface via small diameter conduits, commonly called control lines. Hydraulic fluid in the control line is used to open and close the safety valves to permit fluid flow through the production tubing string, the well annulus, or both and to selectively block or shut in fluid flow as well conditions require. Surface controllers are typically equipped to respond to emergency conditions such as fire, blowouts, broken flow lines, oil spills, etc.

Examples of prior annulus safety systems are described in U.S. Pat. No. 4,049,052 "Subsurface Annulus Safety Valve"; Canadian Patent 117092 "Well Valve" and German Patent No. P 35 41 826. The present invention uses design features such as rod piston actuators shown in U.S. Pat. No. 4,049,052 and German Patent No. P 35 41 826. Copending U.S. Pat. application Ser. No. 07/726,312 filed on Jul. 5, 1991 is directed towards an improved rod piston actuator and seal assembly which can be used with safety valves of the present invention. The present invention resulted from efforts to improve the downhole reliability and flow characteristics of annulus safety valves. Other annulus safety systems are also shown in:

| U.S. Pat. No. | TITLE |
|---|---|
| 4,682,656 | Completion Apparatus And Method For Gas Lift Production Pressure Shut-Off Valve |
| 4,842,074 | Gas Storage Well Safety System and Method |
| 5,022,427 | Annular Safety System For Gas Lift Production |

-continued

| U.S. Pat. No. | TITLE |
|---|---|
| 5,048,610 | Single Bore Packer With Dual Flow Conversion For Gas Lift Completion |

For some well completions, it is desirable to install one or more downhole safety valve at deep depths. For these deep well completions a small piston area is one way to minimize the effect of hydrostatic fluid pressure in the control line leading from the well surface to the downhole valve. Pistons having a small cross section in comparison to the cross section of the complete valve assembly have been used in surface controlled subsurface safety valves. Examples of such pistons are shown in:

| U.S. Pat. No. | TITLE |
|---|---|
| 2,780,290 | Surface Controlled Subsurface Tubing Pressure Shut-Off Valve |
| 2,798,561 | Blowout Preventer for Wells |
| 4,049,052 | Subsurface Annulus Safety Valve |
| 4,161,219 | Piston Actuated Well Safety Valve |
| 4,444,266 | Deep Set Piston Actuated Well Safety Valve |

Since a tubing retrievable safety valve cannot be easily removed from the well bore for routine maintenance, any failure of a fluid seal or accumulation of debris within the safety valve can be very expensive to correct. All sealing systems are subject to failure depending upon the operating environment and design of the seals. For some environments metal-to-metal seals produce longer life as compared to elastomeric materials. Elastomeric, polymeric, and metal-to-metal seal systems have been used in SCSSV's. Examples of metal-to-metal seal systems are shown in:

| U.S. Pat. No. | TITLE |
|---|---|
| 4,452,310 | Metal-to-Metal High/Low Pressure Seal |
| 4,467,870 | Fluid Pressure Actuator for Subterranean Well Apparatus |
| 4,475,598 | Ball Valve Actuating Mechanism |
| 4,527,630 | Hydraulic Actuating Means for Subsurface Safety Valve |
| 4,583,596 | Dual Metal Seal for a Well Safety Valve |
| 4,945,993 | Surface Controlled Subsurface Safety Valve |

Any of the subsurface safety valves shown in the above referenced patents which control downhole fluid flow through a tubing string could be used with the present invention. U.S. Pat. No. 4,945,993 entitled SURFACE CONTROLLED SUBSURFACE SAFETY VALVE shows a tubing safety valve which is planned for use with the annulus safety valve of the present invention.

The previously listed patents are incorporated by reference for all purposes in this application.

SUMMARY OF THE INVENTION

The present invention relates primarily to a safety system for a well having a casing string which partially defines the well bore and a tubing string disposed within the casing string.

A major component of the safety system is an annulus flow safety valve having a housing connectable with the tubing string and a longitudinal bore through the housing to communicate well fluid flow via the tubing string. The exterior of the tubing string and the interior of the casing string partially define an annulus region in the wellbore which can communicate fluid flow in addition to fluid flow through the tubing string.

A valve closure means is mounted on the exterior of the annulus safety valve housing for movement between a first, closed position and a second, open position. A hydraulic actuator in the housing controls movement of the valve closure means between its first position and its second position. The hydraulic actuator normally moves in response to control fluid pressure acting on a small diameter piston and a spring biasing the actuator and valve closure means to move in opposition to control fluid pressure. The valve closure means is used to control fluid flow through the well annulus region.

The present invention allows the use of either metal-to-metal seals or elastomeric seals as part of the hydraulic actuator and the valve closure means as required for optimum performance of the safety system in any specific downhole environment. The net result is a subsurface safety system with increased downhole service life even though well fluids controlled by the safety system may be harmful to some sealing systems.

The annulus flow safety valve of the present invention includes a plurality of flow paths through the annulus safety valve housing and seal means on the exterior of the housing to direct annulus fluid flow through the flow paths. The flow paths have enlarged cross sectional areas to accommodate high fluid flow rates which are frequently required by high volume gas lift wells. Prior annulus safety valves generally used drilled cylindrical flow passageways. The flow paths in the annulus safety valve of the present invention are formed by machining longitudinal slots through the valve housing. The present invention allows the use of electrical discharge machines (EDM) to form the enlarged flow paths in an efficient and cost effective manner.

It is a principal object of the present invention to provide a subsurface safety valve for use at greater depths in oil and gas wells which minimizes the possibility for sand or other debris to hinder prope functioning of the safety valve and maximizes fluid flow when the valve is open.

It is another object of the invention to provide a subsurface safety valve having a valve closure means with metal-to-metal seals and improved piston means which minimizes the number of potential fluid leakage paths. The present invention has metal-to-metal seal which blocks well fluids from entering the control line when the safety valve is in its closed position.

Additional objects and advantages of the present invention will be apparent to those skilled in the art from studying the following detailed description in conjunction with the accompanying drawings and claims.

DESCRIPTION OF THE PREFERRED EMBODIMENT

Figure 1A:
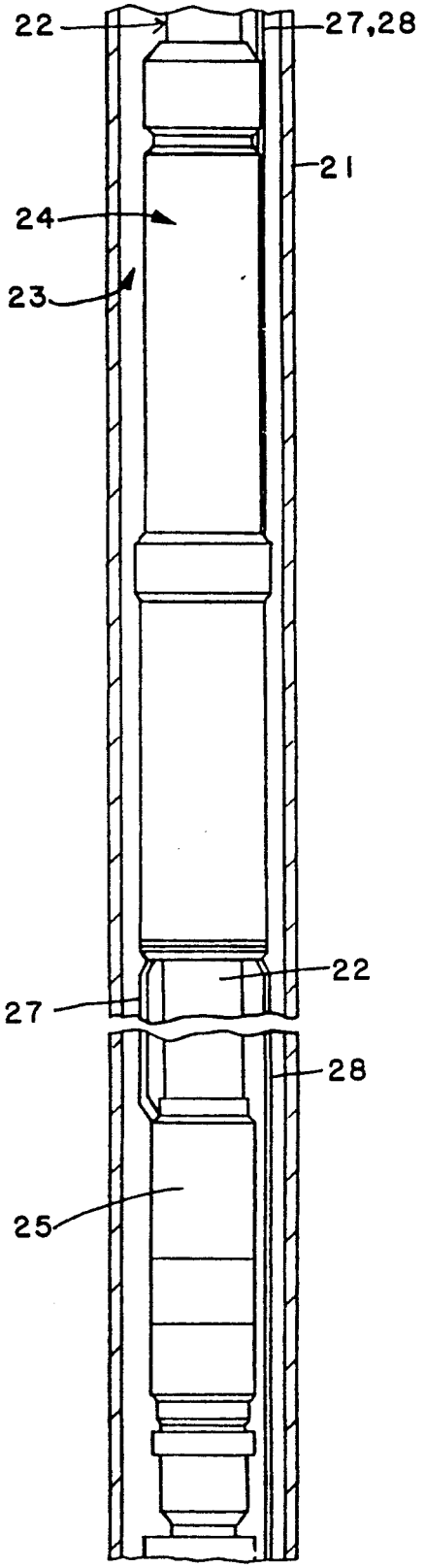
FIGS. 1A and 1B are schematic views in section and elevation of a typical well completion with a downhole safety system including a tubing safety valve and an annulus safety valve and associated tubing string releasably engaged with a casing nipple or a hanger nipple.

In the following description, like parts are designated throughout the specification and drawings with the same reference numerals. The drawings are not necessarily to scale. Portions of some parts have been exaggerated to better illustrate details of the present invention.

Figure 1B:
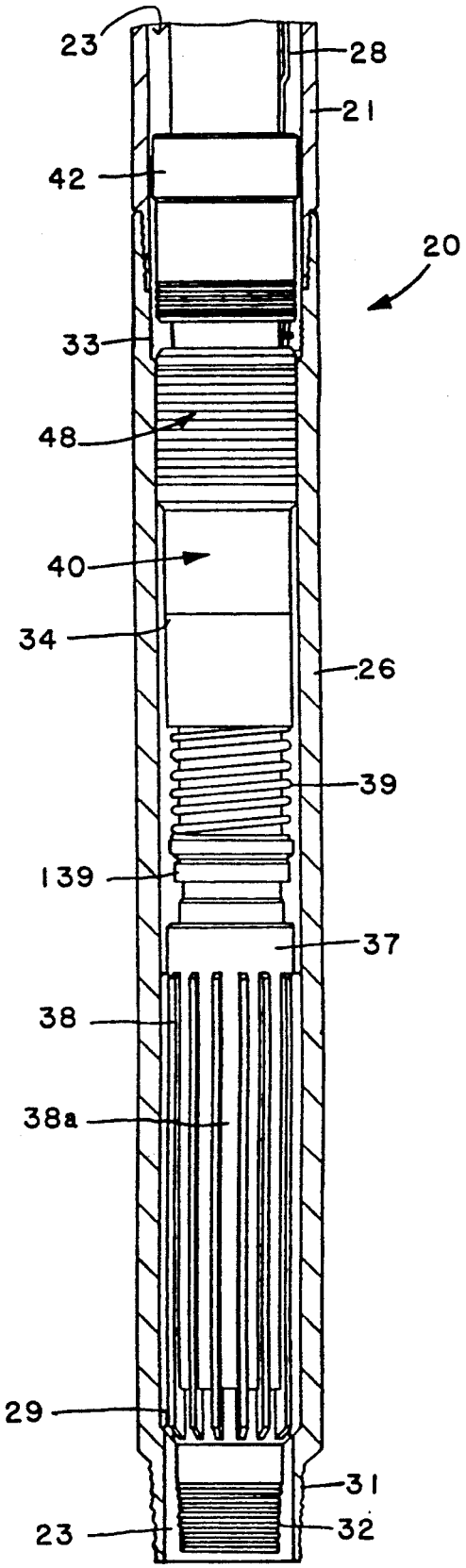

Referring to FIGS. 1A and 1B, a well completion 20 includes a casing string 21 extending from the well surface, not shown, to a hydrocarbon producing formation, not shown. The casing string 21 is a principal component of the well completion 20 and defines the wellbore. A tubing string 22 is concentrically disposed within the casing 21 and extends from a wellhead, not shown, at the well surface to the producing formation. An annulus 23 is formed between the exterior of the tubing string 22 and the interior of the casing string 21. The tubing string 22 is sometimes referred to as a "production" tubing string. Frequently, a well production packer, not shown, is installed at a downhole location above the producing formation to seal between the tubing string 22 and the casing 21. Production packers are used to direct formation fluids such as oil, gas, water, and the like into the tubing string 22 from perforations, not shown, extending through the casing 21 to allow fluid communication between the formation and the wellbore.

The well completion 20 has two major fluid flow paths—the production tubing string 22 and the annulus 23. Formation fluids normally flow to the well surface via the tubing string 22. The annulus 23 may be used to inject gas or other fluids from the well surface to desired downhole locations. Gas injection is frequently used to increase production fluid flow rate through the tubing string 22 as natural formation fluid pressure decreases during the life of the well. Also, corrosion inhibitors and other well treating fluids may be injected from the well surface to selected downhole locations via the annulus 23. Depending upon the type of formation fluid and other well conditions, the annulus 23 may also be used to produce formation fluids in addition to the tubing string 22. This type of dual or parallel flow path to produce formation fluids is sometimes found in gas storage wells which require very high flow rates during periods of peak demand for natural gas.

As shown in FIGS. 1A and 1B, a travel joint 24, a surface controlled subsurface safety valve, used as a tubing safety valve 25 and an annulus safety valve 40 embodying features of the present invention are installed in the well completion 20 as part of the tubing string 22. A casing nipple 26 is installed in the casing string 21 at a selected downhole location. The casing nipple 26, sometimes referred to as a hanger nipple, provides a portion of the means for releasably anchoring the safety valve 40 at the selected downhole location, means for forming a fluid barrier to direct annulus fluid flow through the safety valve 40 and means to support at least part of the weight of the tubing string 22 extending below the safety valve 40. Threads 31 are provided on the lower end of the casing nipple 26 to attach a sufficient length of casing string 21 to reach the desired downhole location. In the same manner threads 32 are provided on the lower end of the safety valve 40 to allow the attachment of a sufficient length of production tubing 22 to reach the desired downhole location.

Figure 2:
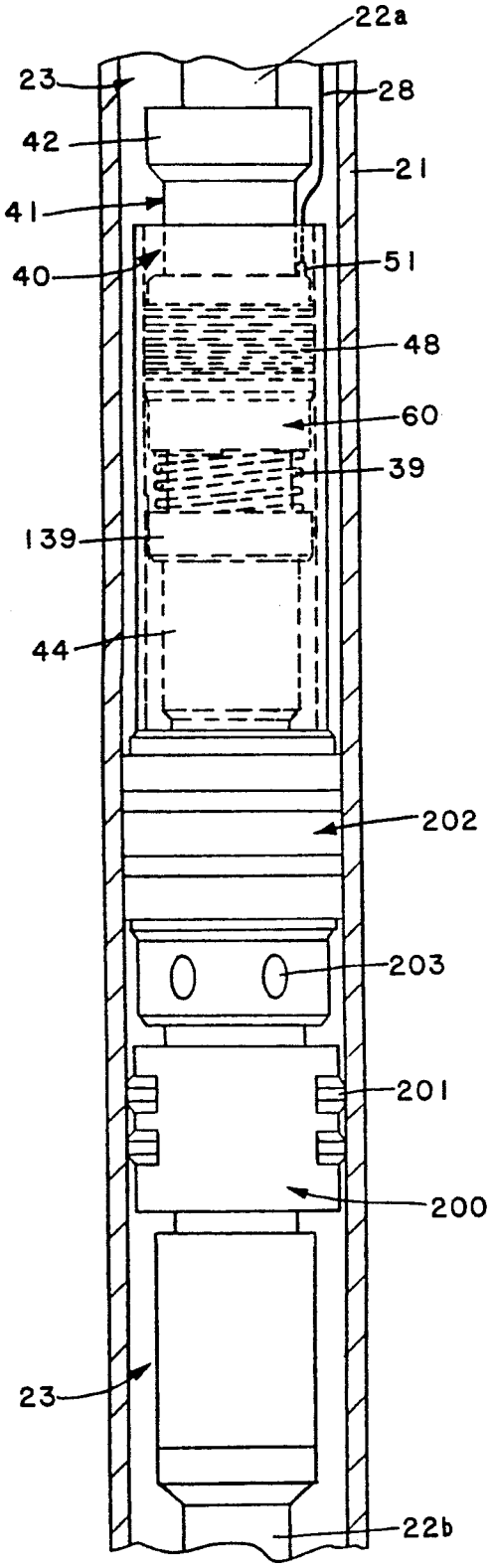
FIG. 2 is a schematic view in section and elevation of a typical well completion with a downhole safety system including the annulus safety valve of FIG. 1 and associated tubing string releasably engaged with a well packer or a hanger packer designed for use with annulus safety systems.

The casing nipple 26 and the annulus safety system packer 200 perform similar functions with respect to the annulus safety valve 40 of the present invention. The annulus safety system packer 200, shown in FIG. 2, will be described in more detail in the Alternative Embodiment section of this written description. The casing nipple 26 includes means for releasably anchoring the safety valve 40 therein such as locking grooves or threads machined in its inside diameter. A releasable anchoring means 33 may or may not be used depending upon well conditions, operating requirements for the safety valve 40, and other components associated with the tubing string 22. As shown in FIG. 1B, the casing nipple 26 also includes a no go shoulder 29 formed on its inside diameter. The releasable anchoring means 33 and no go shoulder 29 are shown spaced longitudinally apart from each other with a polished bore 34 therebetween. The location of these components in the casing nipple 26 can be varied to accommodate alternative configurations of the safety valve 40. The polished bore 34 is provided on the inside diameter of the casing nipple 26 adjacent to the locking means 33 to form a fluid barrier with a seal means 48 carried on the exterior of the safety valve 40.

In FIG. 1B, a fluted hanger assembly 37 is shown attached to the lower end of the safety valve 40. A plurality of longitudinal ribs 38 are provided on the exterior of the fluted hanger assembly 37 to rest on the no-go shoulder 29 and to form longitudinal flow paths 38*a* to allow the annulus fluid flow past the no-go shoulder 29 when the safety valve 40 and the tubing string 22 are resting thereon.

The travel joint 24 is preferably included as part of the tubing string 22 to minimize problems with anchoring the upper end of the tubing string 22 to the wellhead during the initial well completion and to compensate for temperature changes which occur with changes in fluid flow through the tubing string 22 and the annulus 23.

A surface controlled subsurface safety valve 25, sometimes referred to as a tubing retrievable safety valve, controls fluid flow to the well surface via the tubing string 22 from the producing formation. The safety valve 25 is operated by control fluid conducted from a hydraulic manifold, not shown, at the well surface via a control line 27 which directs control fluid signals to the safety valve 25. A similar control line 28 is provided to direct control fluid to the safety valve 40.

The hydraulic manifold generally includes pumps, a fluid reservoir, accumulators, and control valves for the purpose of providing control fluid pressure signals to hold the safety valves 25 and 40 open or to allow the safety valves 25 and 40 to close when desired. The hydraulic manifold also includes apparatus which functions in response to temperature, surface flow line leaks, and other emergency conditions which require shutting in the well 20. A wide variety of tubing retrievable safety valves are commercially available for use as a safety valve 25. Therefore, the safety valve 25 will not be described in any further detail.

A safety valve 40 as shown in FIGS. 3 through 6 can be generally described as a surface controlled subsurface safety valve with an annular type poppet valve closure means 60.

The valve closure means 60 comprises a cylindrical collar slidably disposed on the exterior of the housing means 41 and biased towards its first, or closed, position by spring 39.

Figure 3A:
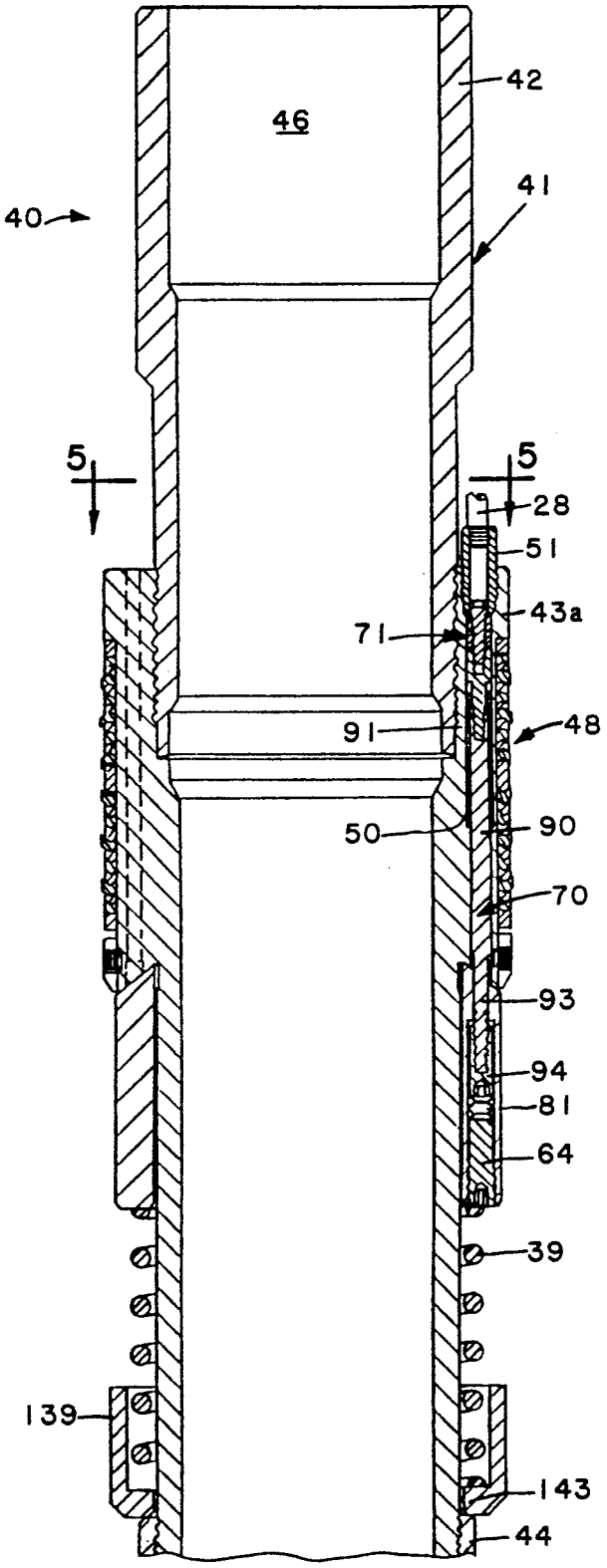
FIGS. 3A and 3B taken together form a longitudinal view in section with portions broken away of the annulus safety valve shown in FIGS. 1 and 2 with the annulus safety valve in its closed position.
Figure 4A:
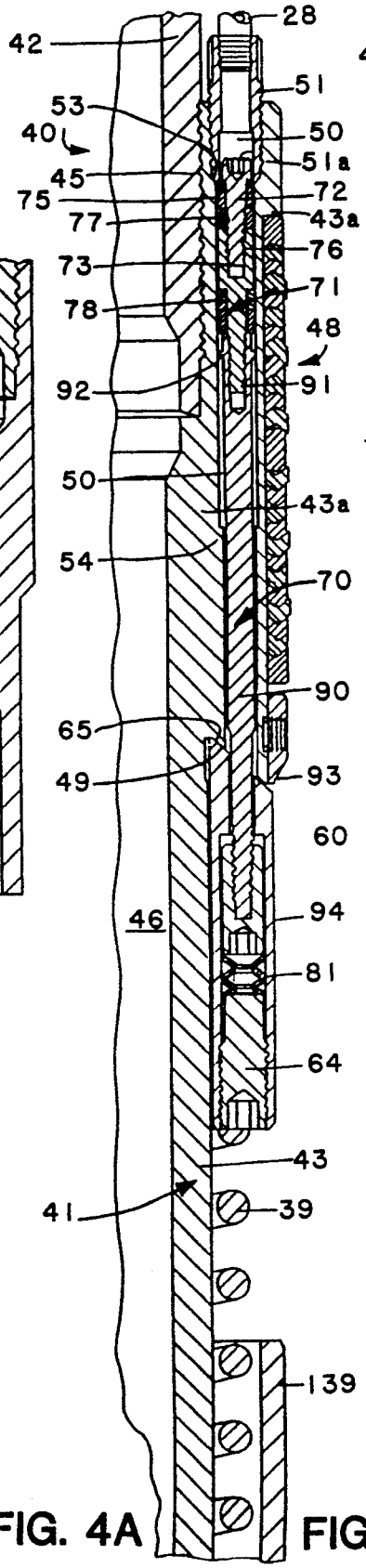
FIG. 4A is an enlarged drawing in longitudinal section with portions broken away of the annulus safety valve in FIG. 3A showing its small diameter piston type hydraulic actuator and valve closure means in their closed position.
Figure 4B:
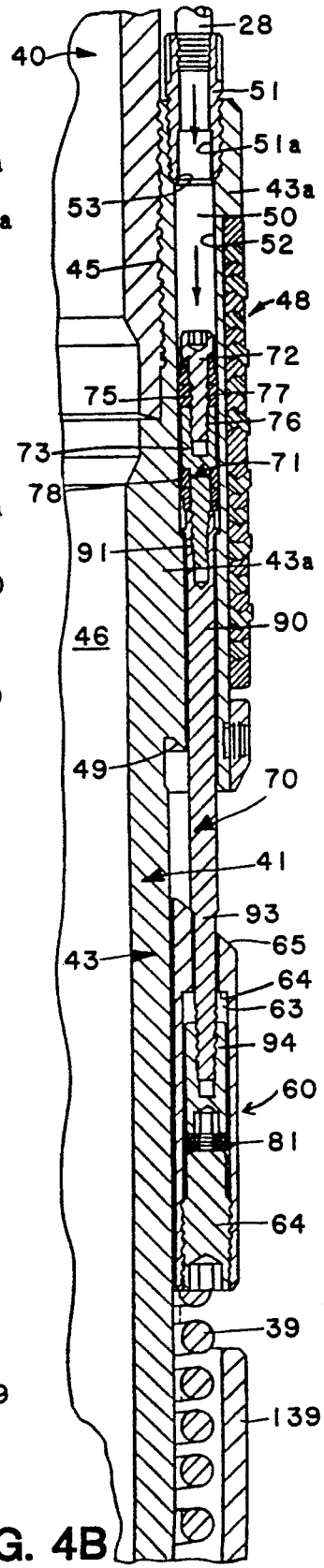
FIG. 4B is an enlarged drawing in longitudinal section with portions broken away of the annulus safety valve in FIG. 3A showing its small diameter piston type hydraulic actuator and valve closure means in their open position.

The safety valve 40, as shown in its first or closed position in FIGS. 3A and 4A, can block undesired fluid flow through the annulus 23. The safety valve 40 in its second or open position, as shown in FIG. 4B, allows fluid flow through the annulus 23. A control line 28 directs control fluid pressure from the well surface to a piston means or hydraulic actuator 70. When a predetermined pressure signal is applied to the safety valve 40 through the control line 28 from the well surface, the valve closure means 60 is maintained in its second, open position. When control fluid pressure is released from the piston means 70 a biasing means or a spring 39 can return the valve closure means 60 to its first, closed position.

Figure 3B:
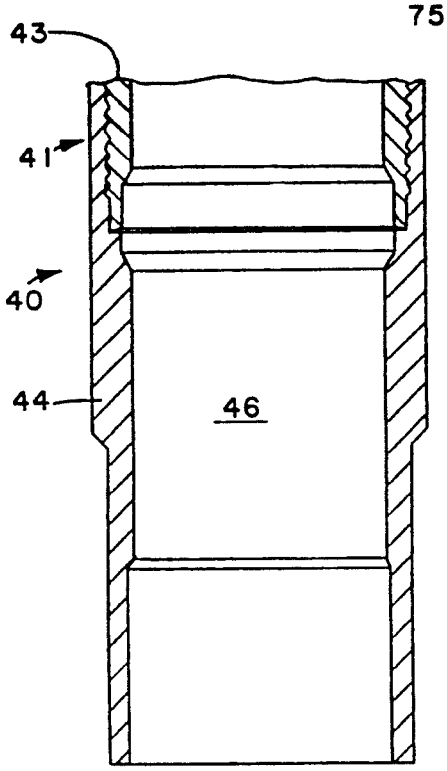

As shown in FIGS. 3A and 3B safety valve 40 includes a housing means 41 formed by housing subassemblies 42, 43, and 44 which are suitably interconnected by threaded joints 45. Subassemblies 42, 43, and 44 could be interconnected by welded joints or by a combination of threads and elastomeric seals. Welding is sometimes unsatisfactory due to requirements for heat treating the housings before and after welding. Elastomeric seals have a tendency to fail during pressure transients when exposed to certain down hole well environments such as high pressure and/or high temperature gas. Threaded joints 45 are often preferred because they have mechanical strength comparable to a welded connection and provide a metal-to-metal seal.

The housing means 41 can be generally described as a long thick walled cylinder with a longitudinal bore 46 extending therethrough. The ends of housing subassemblies 42 and 44 may be internally or externally threaded to provide means on opposite ends of the housing means 41 for connection with the tubing string 22. The dimensions for the longitudinal bore 46 are selected to provide a relatively unrestricted flow path for fluid communication through the tubing string 22. Movement of the valve closure means 60 between its first and second positions does not open or close the longitudinal bore 46. Fluid flow through the longitudinal bore 46 is directly controlled by the tubing safety valve 25. Closing the annulus safety valve 40 may indirectly effect fluid flow through the longitudinal bore 46 if annulus fluid is used to assist fluid flow from the formation to the well surface via the tubing string 22.

Figure 5:
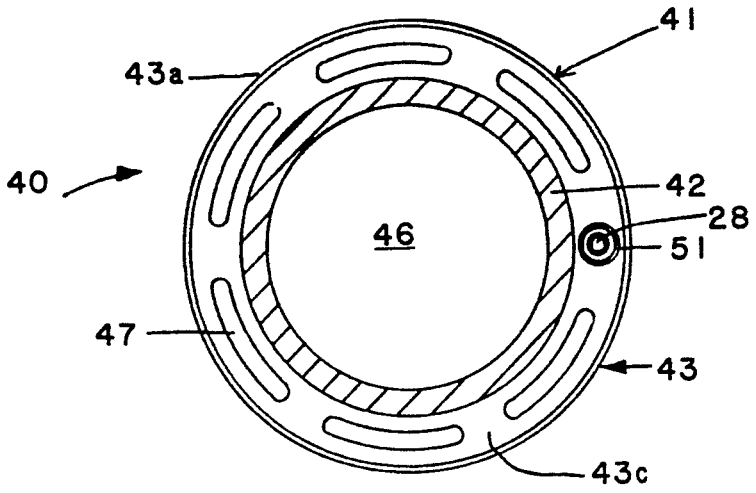
FIG. 5 is a drawing in section taken along line 5—5 of FIG. 3A.
Figure 6:
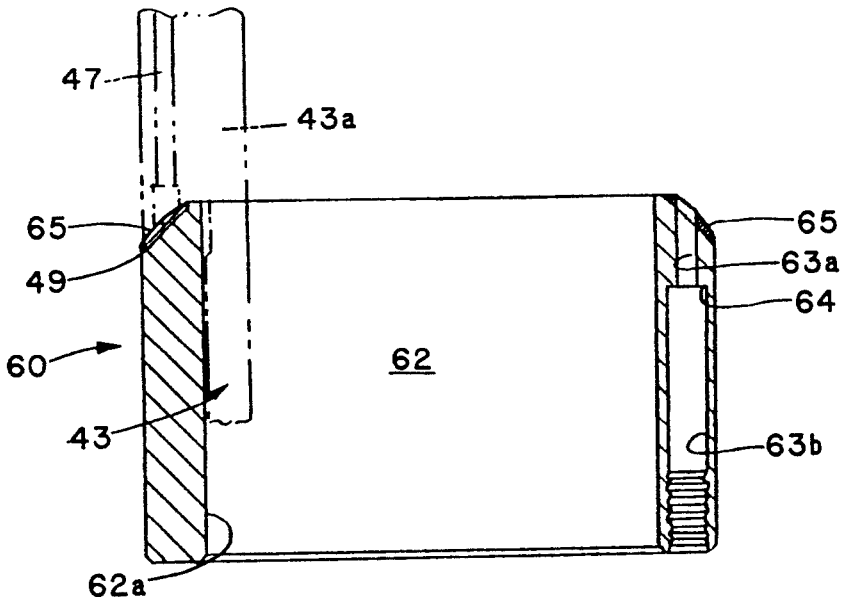
FIG. 6 is an enlarged view in section with portions broken away showing an improved valve closure means with metal-to-metal seals for use with the annulus safety valve of FIGS. 1 through 5.

Most of the main components which comprise the annulus safety valve 40 are provided by or attached to housing subassembly 43. These components include an enlarged outside diameter portion 43a with a plurality of arcuate, oval or eliptical slots 47 machined therethrough. Seal means 48, which are positioned intermediate the openings of the oval slots 47, are carried on the exterior of the enlarged diameter portion 43a to coact with an appropriately sized polished bore to form a fluid barrier. A portion of the inside diameter of the casing nipple 26 or the hanger packer 200 provide the required polished bore. Both the casing nipple 26 and the hanger packer 200 provide a polished bore receptacle to both releasably anchor the safety valve 40 at the desire downhole location and to establish the required fluid barrier to direct annulus fluid flow through slots 47. Electrical discharge machines (EDM) and related manufacturing techniques are preferably used to form the slots 47. The use of EDM results in an optimum or maximum flow area through the slots 47 while retaining the required mechanical strength for the housing subassembly 43. The use of EDM also minimizes manufacturing costs. EDM equipment and procedures are available from several companies. A Hitachi Ultra-Cut Series bridge type wire electrical discharge machine is satisfactory for manufacturing the present invention. The upper end 43c of housing subassembly 43 as shown in FIG. 5 demonstrates the increased flow area achieved by using the slots 47 which have been cut using EDM equipment.

The enlarged diameter portion 43a of the housing subassembly also contains a variable volume piston chamber 50 which is offset from the longitudinal bore 46, with a piston means 70 slidably disposed therein. A threaded connector 51 is used to attach the control line 28 to the safety valve 40. Control fluid pressure signals are communicated from the well surface via the control line 28 and the threaded connector 51 to the piston chamber 50. The piston chamber 50 is machined in the wall of the enlarged diameter portion 43a of the housing subassembly 43 parallel with and offset from the longitudinal bore 46. As best shown in FIG. 5, the slots 47 provide a relatively large flow area as compared to the total cross sectional area of the enlarged diameter portion 43a and the piston chamber 50 provides a relatively small cross sectional area as compared to the total cross sectional area of the enlarged diameter portion 43a. The inside diameter 51a of the threaded connector 51 is smaller than the inside diameter 52 of the piston chamber 50. This change in diameters creates a seating surface 53 therebetween.

The piston means 70, or hydraulic actuator, is slidably disposed within the piston chamber 50 to shift the valve closure means 60 from its first, closed position to its second, open position. The piston means 70 has two main components: a piston seal assembly 71 and a piston rod 90.

The piston seal assembly 71 includes a seat 72 and a piston 73. The seat 72 is similar to a machined bolt and has a metal seating surface 75 provided thereon to mate with the seating surface 53 of threaded connector 51. The seat 72 is attached to the piston 73 by threads 76. Preferably, a spring energized lip seal 77 is disposed on the seat 72 adjacent to the piston 73. The lip seal 77 functions as a backup for metal-to-metal seating surfaces 53 and 75. A second spring energized lip seal 78 is disposed on the exterior of the piston 73. The two lip seals 77 and 78 are designed to only seal from one direction and are arranged to substantially limit fluid flow past the seal assembly 71 from either direction. The seal assembly 71 is attached to the upper end of the piston rod 90 by threads 91. Therefore, the seal assembly 71 and the piston rod 90 move as a single unit in response to control fluid pressure in the piston chamber 50.

The configuration of the seal assembly 71 within the piston chamber 50 results in only one possible leak path for annulus fluids to enter the control line 28 when the safety valve 40 is closed. This leak path is blocked by the engagement of the metal-to-metal seating surfaces 53 and 75 when the safety valve 40 is closed as shown in FIG. 4A. Springs 81 or Belville washers assist in maintaining this metal-to-metal seal when there is only a small difference between the control fluid pressure and the annulus fluid pressure. It is important to note that annulus fluid pressure would only be present at the seating surfaces 53 and 75 if the valve closure means 60 was also leaking. Normally, the valve closure means 60 blocks annulus fluid from the piston chamber 50 when the safety valve 40 is in its closed position.

The piston rod 90 extends longitudinally from the lower end of the piston chamber 50 and is mechanically attached to the valve closure means 60. The metal seating surface 92, provided on the exterior of the piston rod 90, forms a metal to metal seal with the reduced inside diameter 54 of the piston chamber 50 when the safety valve 40 is in its open position.

During assembly of the safety valve 40, the piston rod 90 and the piston seal assembly 71 are inserted into the piston chamber 50 prior to installation of the control line connector 51. Attaching control line connector 51 to the piston chamber 50 traps the piston seal assembly 71 between the metal seating surfaces 53 and 54. These metal seating surfaces define the limit of travel of the piston means 70 within the piston chamber 50.

A reduced diameter portion 93 is provided on the lower end of the piston rod 90 extending from the piston chamber 50. The reduced diameter portion 93 provides part of the means for attaching the valve closure means 60 to the piston means 70. The valve closure means 60 is a relatively short, thick walled cylinder with two passageways 62 and 63 extending longitudinally therethrough. Passageway 62 has a large inside diameter 62a and is sized to slide over the exterior of the housing subassembly 43.

When the safety valve 40 is assembled, the valve closure means 60 and the passageway 62 are concentric with the housing means 41 and the longitudinal bore 46. The passageway 63 is formed in the wall of the valve closure means 60 and has two different inside diameter portions 63a and 63b. This change in inside diameter forms a shoulder 64 intermediate the ends of the passageway 63. The inside diameter portion 63a is sized to receive the reduced diameter portion 93 of the piston rod 90. The inside diameter portion 63b which is larger than the inside diameter portion 63a is sized to receive a locking nut 94. Therefore, after the piston means 70 has been assembled in the piston chamber 50, the valve closure means 60 can slide over the exterior of the housing subassembly 43 to insert the piston rod portion 93 into the passageway 63. The locking nut 94 is then installed through the inside diameter portion 63b to secure the valve closure means 60 with the piston means 70. Assembly is completed by next inserting springs 81 in the inside diameter portion 63b followed by the end cap 64 which closes the passageway 63.

A spring 39 is carried on the exterior of the housing means 41 between a shoulder 143 on the enlarged outside diameter portion 43a and the housing subassembly 44 and abuts the lower end of the valve closure means 60. A sleeve 139 is also carried on the exterior of the housing means 41 to protect the spring 39 during installation of the safety valve 40 into the casing nipple 26 or the hanger packer 200.

An important feature of the valve closure means 60 is the metal seating surface 65 formed on the end of the valve closure means 60 which contacts the enlarged outside diameter portion 43*a* when the safety valve 40 is closed. The metal seating surface 65 is preferably convex with a radius to match a similar concave seating surface 49 on the enlarged outside diameter portion 43*a* of the housing means 41. By properly selecting the radius for seating surfaces 65 and 49, a fluid tight metal-to-metal seal will be established when the valve closure means 60 is in its first position. This metal to metal seal blocks annulus fluid flow through the slots 47. For increased service life, the metal seating surface 65 may be hard faced by various metallurgical procedures.

ALTERNATIVE EMBODIMENTS

For some well completions a hanger packer 200 may be used in place of the casing nipple 26. The use of a hanger packer 200 allows the upper portion 22*a* of the tubing string 22 including the safety valve 40 to be retrieved from the well bore while the packer 200 and the lower portion 22*b* of the tubing string 22 remains installed in the casing 21. The hanger packer 200 includes a plurality of slips 201 to anchor the packer 200 to the interior of the casing string 21 at the desired downhole location. Packer sealing elements 202 are provided on the exterior of the packer 200 to prevent undesired annulus fluid flow between the packer 200 and the casing string 21 after the slips 201 have anchored the packer 200 at the desired downhole location. A plurality of flow ports 203 are provided in the packer 200 to direct annulus fluid communication through the safety valve 40. Various combinations of locking grooves, threads, no-go shoulders and similarly known mechanism may be used to releasably anchor the safety valve 40 within the hanger packer 200 if required by downhole well conditions.

The preceding written description explains only some embodiments of the present invention. Those skilled in the art will readily see other modifications and variations without departing from the scope of the invention which is defined by the claims. It is therefore contemplated that the appended claims will cover any such modifications or embodiments that fall within the true scope of the invention.

What is claimed is:

1. A safety valve for downhole use in a well comprising:
   a. housing means having a bore extending longitudinally therethrough;
   b. a plurality of flow paths formed in a portion of said housing means;
   c. seal means carried by said housing means to direct fluid flow through said plurality of flow paths;
   d. valve closure means mounted on said housing means to control fluid flow through said flow paths;
   e. said valve closure means having a first position which blocks fluid flow through said flow paths and a second position which allows fluid flow therethrough;
   f. means for biasing said valve closure means towards said first position;
   g. an actuator to shift said valve closure means from said first position to said second position; and
   h. each flow path of said plurality of flow paths having a generally elliptical cross section conforming with the cross section of said housing means for accommodating high fluid flow rates therethrough.

2. The safety valve as defined in claim 1 wherein said housing means further comprises:
   a. an enlarged outside diameter portion intermediate the ends of said housing means;
   b. said seal means carried on an exterior of said enlarged outside diameter portion; and
   c. said flow paths extending longitudinally through said enlarged outside diameter portion with openings on either side of said seal means.

3. The safety valve as defined in claim 2 wherein said housing means further comprises:
   a. means for attaching the safety valve to a well tubing string to allow well fluid communication through the longitudinal bore and the tubing string; and
   b. said seal means sized to form a fluid barrier in a wellbore when the tubing string and safety valve are disposed therein.

4. A safety valve for downhole use in a well comprising:
   a. housing means having a bore extending longitudinally therethrough;
   b. a plurality of flow paths formed in a portion of said housing means;
   c. seal means carried by said housing means to direct fluid flow through said plurality of flow paths;
   d. valve closure means mounted on said housing means to control fluid flow through said flow paths;
   e. said valve closure means having a first position which blocks fluid flow through said flow paths and a second position which allows fluid flow therethrough;
   f. means for biasing the valve closure means towards said first position;
   g. an actuator to shift said valve closure means from said first position to said second position;
   h. each flow path of said plurality of flow paths having a generally elliptical cross section conforming with the cross section of said housing means for accommodating high fluid flow rates therethrough;
   i. said housing means further comprises:
      1. an enlarged outside diameter portion intermediate the ends of said housing means;
      2. said seal means carried on an exterior of said enlarged outside diameter portion; and
      3. said flow paths extending longitudinally through said enlarged outside diameter portion with openings on either side of said seal means; and
   i. said actuator is disposed in the enlarged outside diameter portion of said housing means.

5. The safety valve as defined in claim 4 wherein said actuator further comprises:
   a. a variable volume piston chamber in said enlarged portion of said housing means;
   b. means for attaching a control line from the well surface to the piston chamber, and
   c. piston means slidably disposed in the piston chamber for moving said valve closure means in response to control fluid pressure signals from the well surface.

6. The safety valve as defined in claim 5 wherein said piston means further comprises:

a. a piston rod partially disposed within said piston chamber which is offset from said longitudinal bore;

b. a piston seal assembly secured to one end of said rod to form a slidable fluid barrier in said piston chamber;

c. seating surfaces within said fluid chamber to partially define limits for travel of said piston seal assembly therein; and d. matching seating surfaces on said piston means to form a fluid barrier with said piston chamber when said seal assembly has reached the limit of travel in either direction.

7. The safety valve as defined in claim 6 wherein said seating surfaces form metal-to-metal seals when engaged with each other.

8. The safety valve as defined in claim 2 wherein said valve closure means further comprises:

a. a cylindrical collar slidably disposed on the exterior of said housing means adjacent to said flow paths;

b. matching seating surfaces formed on the end of said enlarged diameter portion of said housing means and the end of said cylindrical collar adjacent to each other; and c. said matching seating surfaces of said cylindrical collar and enlarged diameter portion forming a barrier to block fluid communication through said flow paths when the valve closure means is in said first position.

9. The safety valve as defined in claim 8 wherein said seating surfaces form metal-to-metal seals when engaged with each other.

10. The safety valve as defined in claim 8 wherein said biasing means further comprises:

a. a spring disposed on the exterior of said housing means;

b. one end of the spring applying force to said cylindrical collar opposite from said seating surfaces; and c. another end of the spring resting on a shoulder of the exterior of said housing means spaced longitudinally from the enlarged diameter portion of said housing means.

11. A safety valve for downhole use in a well comprising:

a. housing means having a longitudinal bore extending therethrough;

b. an enlarged outside diameter portion intermediate ends of said housing means with a plurality of flow paths formed in said enlarged outside diameter portion;

c. seal means carried by said housing means to direct fluid flow through said plurality of flow paths;

d. valve closure means mounted on said housing means to control fluid flow through said flow paths;

e. said valve closure means having a first position which blocks fluid flow through the flow paths and a second position which allows fluid flow therethrough;

f. means for biasing the valve closure means towards said first position;

g. an actuator in the housing means to shift the valve closure means from said first position to said second position;

h. matching seating surfaces formed on the end of the enlarged diameter portion of said housing means and the end of the valve closure means adjacent to each other;

i. said matching seating surfaces of said valve closure means and enlarged diameter portion forming a metal-to-metal seal to block fluid communication through said flow paths when said valve closure means is in said second position; and i. each flow path of said plurality of flow paths having a generally elliptical cross section conforming with the cross section of the housing means for accommodating high fluid flow rates therethrough.

12. The safety valve as defined in claim 11 further comprising:

a. said seal means carried on the exterior of said enlarged outside diameter portion;

b. said flow paths extending longitudinally through said enlarged outside diameter portion with openings on either side of said seal means.

13. The safety valve as defined in claim 12 wherein said housing means further comprises:

a. means for attaching the safety valve to a well tubing string to allow well fluid communication through said longitudinal bore and the tubing string; and b. said seal means sized to form a fluid barrier with the interior of a casing string when the tubing string and safety valve are disposed therein.

14. A safety valve for downhole use in a well comprising:

a. housing means having a longitudinal bore extending therethrough;

b. an enlarged outside diameter portion intermediate the ends of said housing means with a plurality of flow paths formed in said enlarged outside diameter portion;

c. seal means carried by said housing means to direct fluid flow through said plurality of flow paths;

d. valve closure means mounted on said housing means to control fluid flow through said flow paths;

e. said valve closure means having a first position which blocks fluid flow through the flow paths and a second position which allows fluid flow therethrough;

f. means for biasing said valve closure means towards said first position;

g. an actuator in said housing means to shift said valve closure means from said first position to said second position;

h. matching seating surfaces formed on the end of said enlarged diameter portion of said housing means and the end of said valve closure means adjacent to each other; and i. said matching seating surfaces of the valve closure means and enlarged diameter portion forming a metal-to-metal seal to block fluid communication through said flow paths when said valve closure means is in said second position;

i. each flow path of said plurality of flow paths having a generally elliptical cross section conforming with the cross section of the housing means for accommodating high fluid flow rates therethrough;

k. said seal means carried on the exterior of the enlarged outside diameter portion;

i. said flow paths extending longitudinally through said enlarged outside diameter portion with openings on either side of said seal means; and m. the actuator is disposed in said enlarged outside diameter portion of said housing means.

15. The safety valve as defined in claim 14 wherein the actuator further comprises:

a. a variable volume piston chamber in said enlarged outside diameter portion of said housing means;

b. means for attaching a control line from the well surface to said piston chamber, and c. piston means slidably disposed in said piston chamber for moving said valve closure means in response to control fluid pressure from the well surface.

16. The safety valve is defined in claim 15 wherein said piston means further comprises:

a. a piston rod partially disposed within said piston chamber offset from said longitudinal bore;

b. a seal assembly secured to one end of said piston rod to form a slidable fluid barrier in said piston chamber;

c. seating surfaces within said piston chamber to partially define limits for travel of said piston means therein; and d. matching seating surfaces on the piston means to form a fluid barrier with said piston chamber when said piston means has reached the limits of travel in either direction within said piston chamber.

17. The safety valve as defined in claim 16 wherein said seating surfaces form metal-to-metal seals when engaged with each other.

18. The safety valve as defined in claim 11 wherein said valve closure means further comprises a cylindrical collar slidably disposed on said exterior of the housing means adjacent to the flow paths.

19. The safety valve as defined in claim 18 wherein said seating surfaces of said valve closure means and the enlarged outside diameter position have matching convex and concave radii of curvature to form metal-to-metal seals when engaged with each other.

20. The safety valve as defined in claim 18 wherein said biasing means further comprises:

a. a spring disposed on the exterior of said housing means;

b. one end of said spring applying force to said cylindrical collar opposite from said seating surfaces; and c. another end of said spring resting on a shoulder of the exterior of said housing means spaced longitudinally from said enlarged outside diameter portion of the housing means.

* * * * *